United States Patent [19]

Grabel et al.

[11] 4,243,222

[45] Jan. 6, 1981

[54] SEESAW TARGETS APPARATUS FOR PINBALL GAME

[75] Inventors: Irwin J. Grabel, Elmwood Park; Peter J. Hanchar, Chicago, both of Ill.

[73] Assignee: Bally Manufacturing Corporation, Chicago, Ill.

[21] Appl. No.: 23,083

[22] Filed: Mar. 23, 1979

[51] Int. Cl.[3] ..... A63F 7/06

[52] U.S. Cl. ..... 273/127 R

[58] Field of Search ..... 273/127 R, 127 A, 127 B, 273/127 C, 121 A, 121 D, 121 E, 121 R, 118 R, 118 A, 118 D, 119 R, 119 A, 120 R, 120 A, 122 R, 122 A, 123 R, 123 A, 124 R, 124 A, 125 R, 125 A, 126 R, 126 A, 102.2 R; 200/61.11, 61.1

[56] References Cited

U.S. PATENT DOCUMENTS

| | | | |
|---|---|---|---|
| 3,647,212 | 3/1972 | Barlow | 273/127 R |
| 3,975,019 | 8/1976 | Barlow | 273/127 R |
| 4,037,842 | 7/1977 | Breslow | 273/127 R |

*Primary Examiner*—Richard C. Pinkham
*Assistant Examiner*—T. Brown
*Attorney, Agent, or Firm*—Fitch, Even, Tabin, Flannery & Welsh

[57] ABSTRACT

An alternate target configuration is disclosed for a pinball game apparatus or the like, where two adjacent targets are mounted within a frame on the underside of the apparatus playfield, each adapted to move through a playfield opening between an exposed position above the playfield and a hidden position below the playfield. A linkage including an elongated member medially pivoted to the frame in the fashion of a seesaw is connected at its opposite ends to the respective targets, preferably when one target is exposed and the other target is hidden. The linkage is effective to shift both targets simultaneously from one alternate target position to another alternate target position where the other target is exposed and the one target is hidden. A spring toggles the seesaw linkage resiliently to the extreme limit of travel in each alternate target position. A motor overrides the spring toggle through an alternately reversed ratchet type connection to shift the seesaw linkage and reverse the positions of the targets. The motor is activated responsive to the exposed target being hit by the ball, and appropriate scoring apparatus is then energized.

8 Claims, 6 Drawing Figures

SEESAW TARGETS APPARATUS FOR PINBALL GAME

BACKGROUND OF THE INVENTION

Pinball game apparatus are widely used in recreational centers, lounges and game rooms as competitive forms of social entertainment. Such games uniformly use a playing ball that is ejected to the upper end of a downwardly pitched playfield. The ball then moves under the influence of gravity through a maze of lanes formed by ball directing means such as target and bumper elements of various forms and ultimately to one or more out of play lanes that are generally located at the lower end of the playfield. As the ball moves through the lanes and contacts the target and bumper elements, appropriate circuits are completed to accumulate scoring points and further frequently to energize motor means for repowering the ball randomly over the playfield. The player can partially control the movement of the ball by limited jarring of the playfield and further through the activation of manually operated electrically driven flippers located on the playfield, typically at least a pair of which guard the lowermost out of play lane. When properly activated, the flippers slap the ball and redirect it toward the top of the playfield or toward specific target areas in the playfield. During the play, lights are typically illuminated at various locations on both the playfield and on a scoring display board extending upwardly from the upper end of the playfield and audible devices such as bells or chimes are normally activated in response to selective ball directing means being hit by the ball.

One form of ball directing means located on the playfield may include a kickout hole which receives the ball and momentarily holds it before motor powered ejection mechanism kicks it back onto the playfield. Another form of ball directing means is the drop target, which in the exposed position upstands from the playfield adapted to be struck by the ball and which then is shifted by activated motor means to a hidden position below the playfield. A variation of this is the scoring target which extends upwardly from the playfield and which is deflected when struck by the ball to activate scoring means that restraightens the target and in turn kicks the ball away. Additional ball deflecting means include the pop bumper and/or thumper bumper. Each of these generally is in the form of a mushroom like pedestal that has an upper ring and a lower annular skirt spaced from the ring. When the ball comes against the thumper bumper with sufficient force, it causes the lower skirt to be deflected and close a control switch. The closing of the switch energizes motor means which rapidly shifts the upper ring downwardly and the downward action kicks the ball away from the thumper bumper. It is typical to locate a plurality of other ball directing means in close proximity to the top or thumper bumper so that the ball movement is both rapid and multidirectional. Additional ball directing means include the straight bumper and the kicker or slingshot bumper, which most commonly are used to define ball travel lanes and/or for protecting specific scoring targets located on the playfield. The straight bumper typically is formed only of a resilient material, e.g., wire or rubber; while the kicker or slingshot bumper is powdered by motor means responsive to the bumper being struck by the ball to repower the ball away from the bumper.

As has been noted above, when the ball passes through certain lanes and when the ball strikes certain ball directing means, counting circuits are actuated and the score is totaled. By incorporating a logic in the counting or scoring system, definite or more preferred targets must be bit by the operator in order to accumulate a high total score. The variations of game scoring vary widely, as does the kinds and placement of the ball directing means about the playfield. The player operator is challenged to maintain continuing play and control of the ball by timely actuation of the flippers and to redirect the ball according to some specified game plan for activating the various ball directing means on the playfield. During the rapid movement of the ball about the playfield, high degrees of skill and quick reflexes must be brought into play in order to obtain the full benefit of the player controlled flippers in redirecting the ball for additional scoring and in keeping the ball away from the out of play lane. This adds to the challenge and appeal of the pinball game apparatus, since it distinguishes a skilled player from an average or mediocre player.

Generally, an apparatus having a challenging but controlled game format, with other operating features such as multiple player play, compounding or bonus scoring systems, and bonus ball replays, will be accepted and will be in great demand in the marketplace. However, because experienced players become rather selective in the pinball game apparatus on which they prefer to play, the owners and therefore the suppliers of such apparatus are constantly looking for new game formats and new features to add to the pinball game apparatus to make the overall play more appealing. For these reasons, new features are continually being built into pinball game apparatus which hopefully will appeal to both players and owners.

However, even though any single feature might appeal to the player, it must be of reliable and durable construction and operation, and it must be capable of economical incorporation in the game apparatus to appeal also to the manufacturer and owner.

SUMMARY OF THE INVENTION

This invention relates to pinball game apparatus of the type having a playfield and a ball that is designed to move about on the playfield and against and past specific ball directing means, and specifically teaches an improved alternate target configuration utilizing two spaced targets, each of which is movable between exposed and hidden positions. Linkage means interconnects the targets to shift them simultaneously between a first target position where one target is exposed and the other target is hidden; and an alternate target position where the one target is hidden and the other target is exposed. Motor means acts on the linkage means to shift the targets between the alternate positions in response to the exposed target being hit by the moving ball. Appropriate scoring means for the pinball game apparatus are likewise then energized.

A BRIEF DESCRIPTION OF THE DRAWINGS

Figure 6:
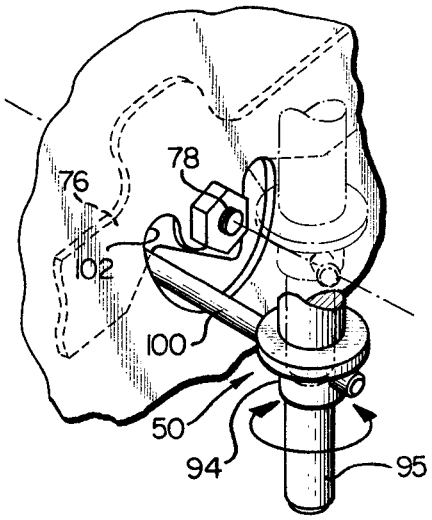
Figure 3:
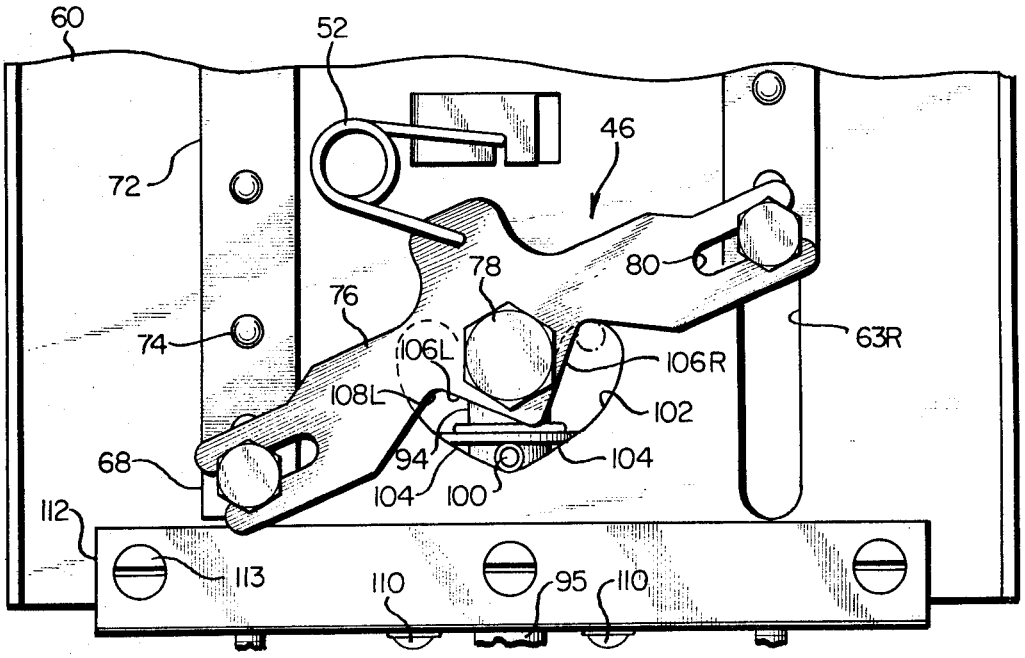
FIG. 3 is a view similar to FIG. 2, except showing the alternate target means in its alternate position.
Figure 2:
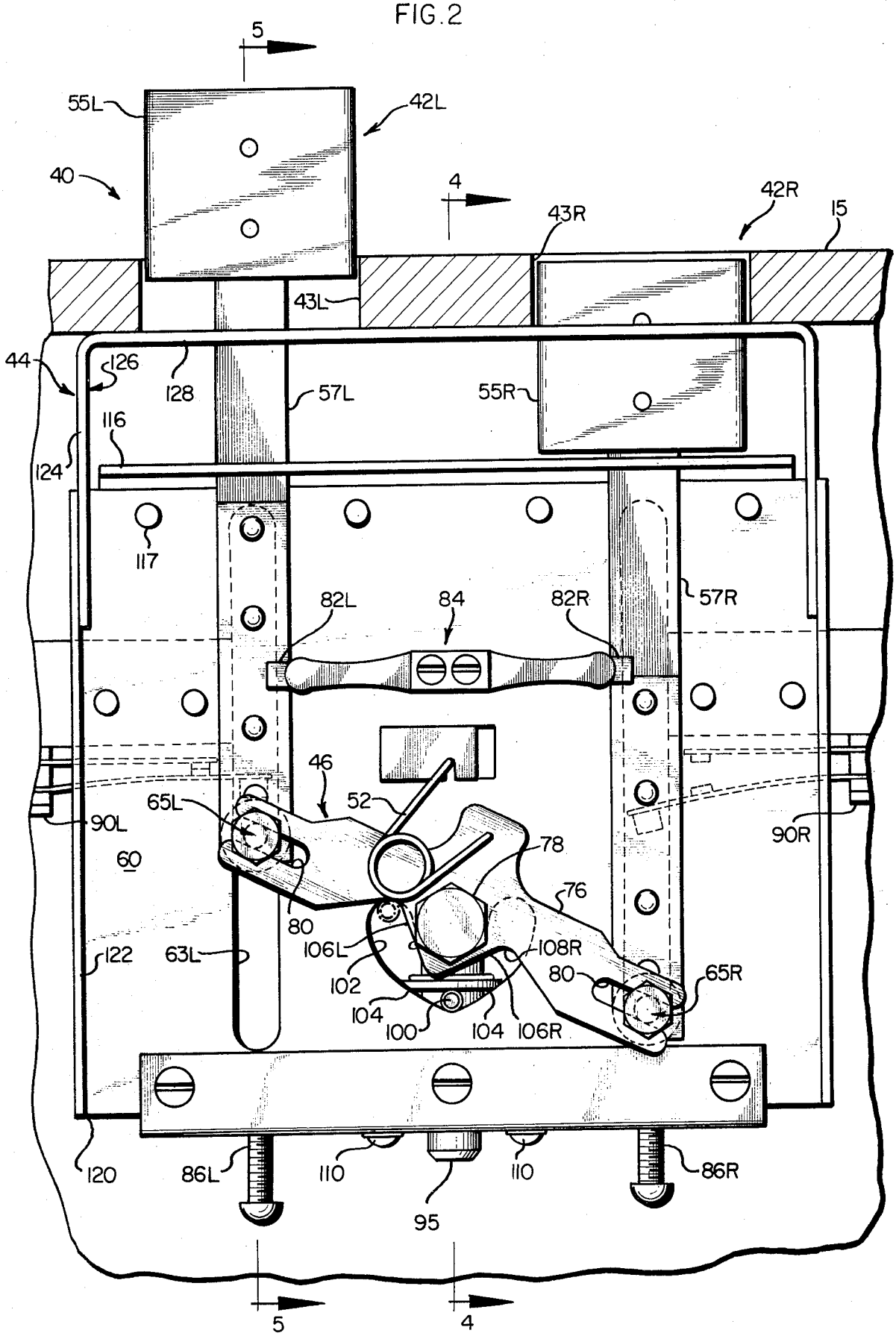
FIG. 2 is an enlarged frontal view, partially broken away and in section, of the improved alternate target means of this invention.
Figure 4:
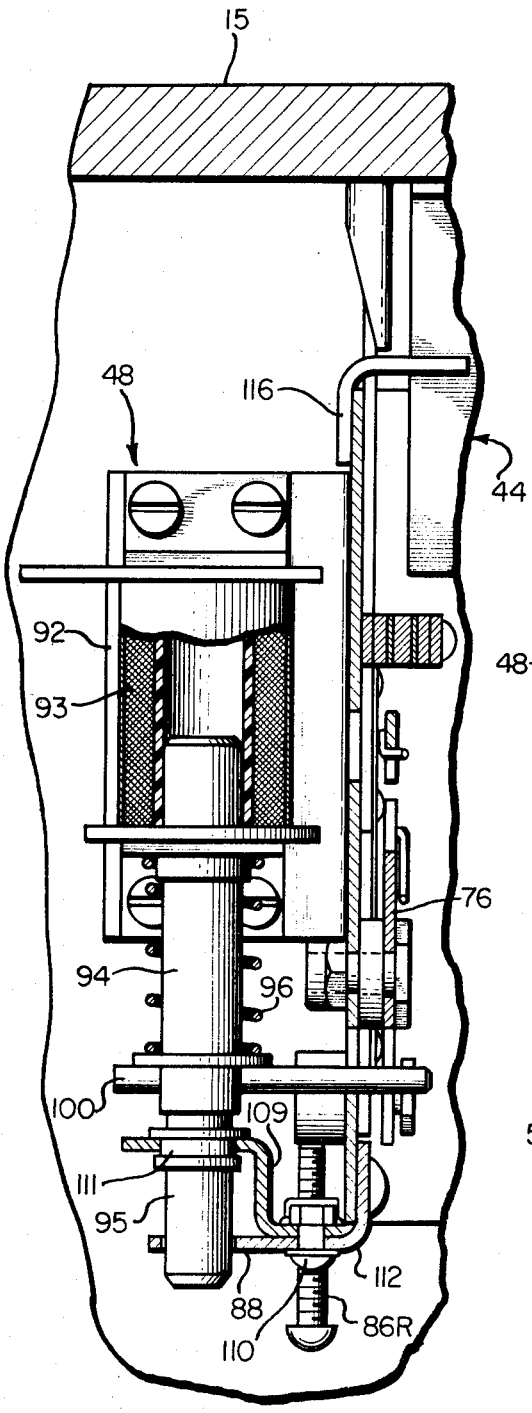
Figure 5:
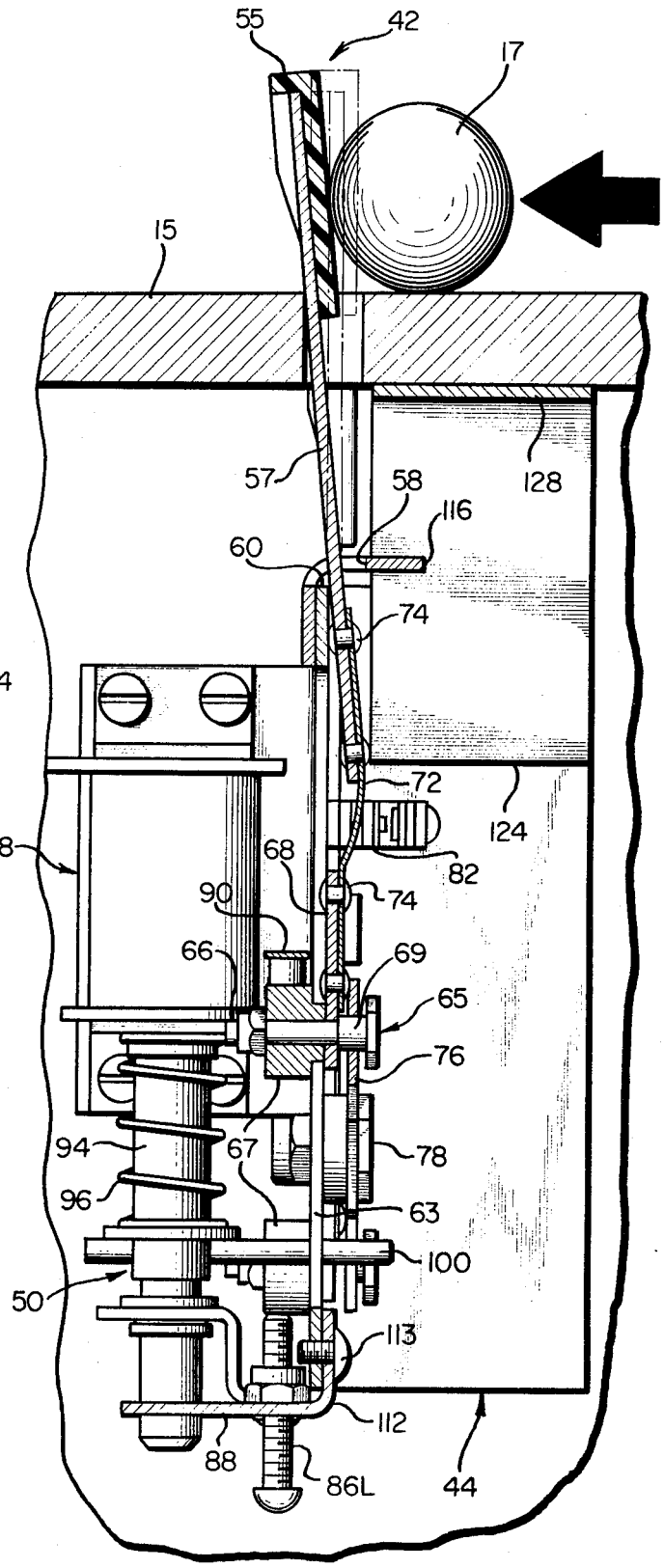

FIGS. 4 and 5 are sectional views of the device shown in FIGS. 2 and 3, as taken generally along the lines 4—4 and 5—5 respectively, in FIG. 2; and FIG. 6 is a pictorial schematic view illustrating the alternatively reversed ratchet type connection used between the motor and linkage means of the alternate target means of this invention.

DETAILED DESCRIPTION OF THE INVENTION

Figure 1:
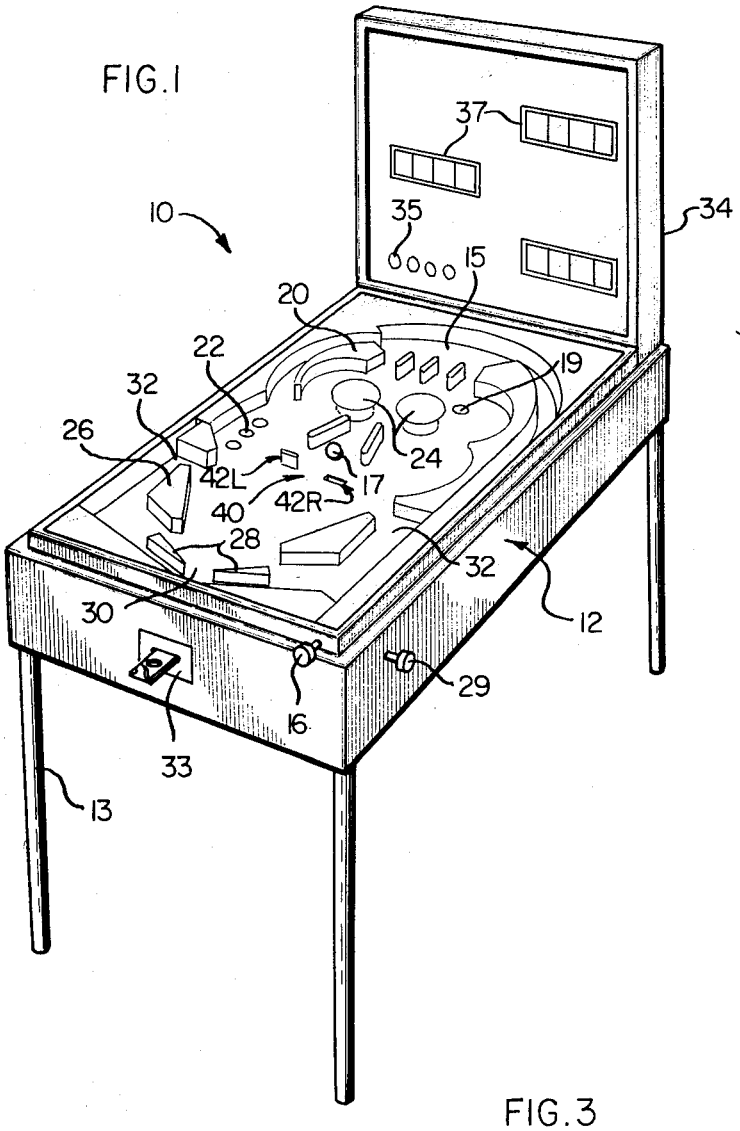
FIG. 1 is a perspective view of a typical pinball game apparatus, and illustrating how the subject invention might be incorporated and used therein.

Referring initially to FIG. 1, the illustrated pinball game apparatus 10 includes an upper cabinet 12 supported on legs 13 approximately at waist height to the usual game player. The cabinet 12 has a glass top beneath which is located a slightly inclined bordered playfield 15. A manual ball feeding mechanism 16 is located at the lower right hand corner of the playfield and is used for ejecting a round ball 17 to the upper end of the playfield 15 at the start of play. The ball then rolls under the influence of gravity downwardly over the slightly inclined playfield against and past the various ball directing and target means located on the playfield. In the illustrated apparatus, some ball directing and target means shown include kick out holes 19, upper guide rails 20, spaced drop targets 22, thumper bumpers 24, and slingshot kicker 26. Additionally, flippers 28 selectively controlled by manual left and right actuators 29 straddle a central out of play lane 30. A pair of side out of play lanes 32 are also defined on the sides of the playfield between the spaced ball directing means 22 and 26. In the typical game, once the ball passes through an out of play lane, it is lost; and either a subsequent ball is then available to be put into play or the game is over. A coin mechanism 33 is located on the front of the cabinet to accept coins in the proper amount to enable play for the number of players desired. A back cabinet 34 is typically also provided, being glass covered and having suitable decorative and game operation material thereon. Thus, player indicating means 35 advises visually which player is playing, and the players' score area 37 provides continuous updated scores in digital display for the respective players. Other indicators can include a tilt notice, ball in play indicators and flashing score related lights not specifically identified.

The particular selection or arrangement of the ball directing and/or target means illustrated on the playfield forms no part of the subject invention, but has been given only as representative of a typical pinball game apparatus. Obviously, the game apparatus may vary widely with respect to the particulars of the scoring as the ball moves about the playfield and against the various ball directing means and/or target means. Basically, however each ball directing or target means, upon being hit by the ball, either redirects the ball, adds to the score of the player, or a combination of both. A control disclosed in the Nutting et al. U.S. Pat. No. 4,093,232 can be provided for totaling the score and for illuminating the lights, according to some prearranged logic of the game apparatus as the ball comes about the playfield.

The alternate target mechanism 40 of the present invention shown generally in FIG. 1 and more specifically in FIG. 2 is also located on the playfield 15 and is comprised of two targets indicated generally at 42L and 42R, each of which fit through respective openings 43L and 43R in the playfield. The targets are supported by frame structure 44 below the playfield and move through the playfield openings between an exposed position above the playfield and a hidden position below the playfield. As best shown in FIG. 2, a linkage means 46 interconnects the targets in one alternate target position when one of the targets is exposed above the playfield (target 42L) and when the other of the targets is hidden below the playfield (target 42R). The linkage means 46 is effective to shift the targets to the other alternate target position where the positions of the targets are reversed (see FIG. 3). Suitable motor means 48, responsive to the exposed target being hit by the ball and acting through appropriate connection means 50, shifts the linkage means 46 and thereby reverses the positions of the targets. A spring 52 toggles the linkage means to each alternate target position. Inasmuch as the construction of each target 42 is virtually the same, the detailed construction of the targets will now be described insofar as might typically be applied to either, and where appropriate the suffix L or R will be used to distinguish the left or right target as viewed by the player from the lower portion of the playfield.

Each target 42 typically is in the form of a colorful plate 55 (see FIGS. 2 and 5) connected on its rear side to a generally inflexible bar 57 that extends through and is guided within an opening 58 in the upper part of the frame 44. The frame 44 further presents a panel 60 disposed generally normal to the underside of the playfield 15 and further which has formed therein a pair of elongated slots 63L and 63R located in alignment generally with the respective playfield openings. A slide element 67L and 67R fits within each slot 63 and is confined laterally of the panel to reciprocate in the direction along the length of the slot. The slide element has a bolt 66 extended through the slot and connected to a slide element 67 on one end and a bar 68 on the other end, each of which laps the edges of the panel 60 adjacent the slot 63 to maintain the slide element 67 in place. Additionally, the bolt has a necked shank section 69 outwardly adjacent the bar. The bars 57 and 68 are spaced apart at their adjacent ends, and a flexible spring bar 72 spans this spacing and is secured by rivot means 74 or the like in flush overlying relation to the bars. Thus, the target plate 55 and bar 57 are connected to the slide element 67 and bar 68 across the bar spring 72, and the target can reciprocate in a direction generally normal to the playfield between the exposed and hidden positions.

The linkage means 46 is in the form of an elongated member 76 that is pivotally connected to panel 60 at its midpoint by connection 78. The opposite ends of the elongated member 76 are provided with open ended slots 80 which fit over the shank sections 69 of the slide elements 65 and thereby become mechanically connected to the slide elements. As will be apparent, this linkage is in the form of a seesaw and interconnects the respective targets in that when one of the targets is in the hidden position, the other of the targets is in the exposed position.

In normal play, the impact of the moving ball striking the exposed target (42L in FIG. 2, for example) will deflect the target in the same directions as the ball movement and generally laterally of the upper support bar 57 and crosswise of the upper guide means at frame opening 58. Since the lower guide means at slide element 67 is laterally confined, the spring bar 72 is laterally flexed or bowed away from the frame panel 60. This bowing deflection is detected by arm 82L or 82R of sensing switch 84 supported on the frame panel 60 adjacent the bowing part of the spring 72L and 72R when the corresponding target is exposed. Thus, the ball striking the target and the resulting flexure of the spring arm causes the switch 84 to be actuated, and this signal is used to detect a hit on the target and to actuate the motor means 48.

As will be appreciated, the spring 52 is under compression between its connection at the frame panel 60 and its connection on the elongated member 76, and these connections and the pivot connection 78 for the seesaw linkage member 76 all line up when the seesaw member is at a dead center position where the two targets are each partially exposed and partially hidden. This spring thereby toggles and seesaw linkage means to either alternate target position and resiliently holds the targets in either of the alternate positions. In this regard, each alternate target position is readily adjusted by means of adjustable stop 86L or 86R in the form of a bolt threaded through a flange 88 on the panel 60, which bolt is adapted to abut the bumper 67 on the slide element 65. The adjustment of the hidden target also adjusts the position of the opposite exposed target. Further, a position indicator switch 90L and 90R is positioned to detect when the exposed target approaches or is in its fully exposed position, at which position the slide element 67 actuates the position indicator switch. The spring 52 thereafter retains the targets in the new alternate position.

With respect to the specific connection means 50 of the motor means 48 to the linkage means 46, it should be appreciated from FIGS. 2, 4 and 6 that the motor means is in the form of a solenoid 92 having a stationary coil 93 and a movable core or armature 94 with a reduced diameter cylindrical extension 95 which is adapted to reciprocate along a linear path. A coil compression spring 96 holds the armature in its outwardly extended or unactuated position. The solenoid 92 is mounted on the panel 60 of the frame 44 so that the armature moves along an axis that is transverse to and intersects the pivot axis through pivot connection 78 of the seesaw member 76. A finger 100 is carried by the armature and extends transversely relative the armature's axial movement and the finger 100 also extends through an opening 102 in the frame panel 60 and beyond the member 76. The opening in the frame is somewhat heart-shaped with two converging lower faces 104 meeting at a corner against which the finger normally rests in its neutral position under the influence of the spring 96. In this location, the finger 100 is aligned with the pivot connection 78 or pivot axis of the seesaw member and with the connections of the toggle spring 52. The elongated seesaw member further has diverging cam faces 106L and 106R on both sides of the dead center location, the cam faces extending transversely of and in spaced relation from the pivot connection 78 and each terminating at a shoulder 108L and 108R spaced also from the pivot axis. It is noted from FIGS. 2 and 3 that when the seesaw member 76 is positioned with its controlled targets in either alternate position, the cam face 106 associated with the hidden target is in overlying canted relationship to the finger 100 in its neutral position. The finger is rotatable about the axis of the armature, preferably by having the armature rotatable within the coil.

In operation, actuation of the motor means axially shifts the armature 94 and the finger 100 carried by it, whereupon the finger strikes the cam face initially and then rides along the cam face while incidentally rotating the finger until it abuts the shoulder 108. Continual axial movement thereupon causes the elongated seesaw member to rotate in a corresponding direction about the pivot axis to lift the hidden target to the exposed position and conversely lower the exposed target to its hidden position. After the motor means has been deenergized and the targets have been shifted, this allows the armature to return under the bias of the spring 96 to its extended position and further to relocate the finger 100 in its neutral position. At this time the positioned finger underlies the opposite cam face which again corresponds to the hidden target. To insure that the armature 94 is accurately centered during its reciprocal movement, a guide bracket 109 is provided, the lower end of which is attached to the flange 88 by screws 110 or the like. The upper end carries a nylon bushing 111 which permits low friction movement therebetween and the inside diameter of the bushing 111 is slightly larger than the outside diameter of the extrusion 95 that rides within it. The portion of the flange 88 where the extension 95 would otherwise contact has a suitable opening to enable uninterrupted movement by the end of the extension below the elevation of the flange.

Thus, the connection means 80 between the motor means 48 and the linkage means 46 acts almost in the manner of a single indexing ratchet that is alternately reversed after every index cycle.

With respect to some additional details of construction, the flange 88 can be defined as part of an angle 112 secured by bolts 113 or the like to the lower portion of the frame panel 60. Likewise, the upper target bar guide means at opening 58 can take the form of an angle 116 secured by bolts 117 or the like to the upper portion of the frame panel 60, and having the appropriate receiving openings formed therein. The specific frame itself can be in the form of a U-shaped component 120 having the previously named panel 60 and adjacent forwardly facing side flanges 122, to which the side flanges 124 of a second U-shaped component 126 can be secured as by spot welding or the like. The interconnecting web 128 of the component 126 can be secured directly to the underside of the playfield. Thus, the entire target mechanism 40 is conveniently supported as a unit relative to the playfield and only the electrical connections for the power and control thereafter need be made separately in order to have the mechanism working in a pinball game apparatus.

From the foregoing, it should be appreciated that a novel alternate target device has been described which is rugged and reliable in its operation. The unique linkage means which move the separate targets together with the manner in which the single motor means is effective to move the linkage means in either direction provides simple reliable operation and is easily serviceable in the event replacement of worn components is needed after extended use.

Although certain preferred embodiments have been shown and described, various alternatives, modifications and substitutions will be apparent to those skilled in the art. Accordingly, the scope of the present invention should be only defined by the appended claims and equivalents thereof.

Various features of the invention are set forth in the following claims.

What is claimed is:

1. An alternate target apparatus for use in a pinball game having a playfield and at least one ball movable on the playfield, said apparatus comprising:

a pair of spaced apart targets, each of which can extend through openings in said playfield and be struck by the ball moving on the playfield;

linkage means supporting each of said targets;

said linkage means being operatively connected to said targets so that one target has portions thereof exposed through one of said openings in position to be struck by said at least one ball moving on the playfield when the other target is hidden below said playfield out of the path of said at least one ball moving on said playfield, said linkage means being adapted to simultaneously move both targets between the exposed and hidden positions;

means for shifting said linkage means in response to being driven by a motor means;

motor means operatively connected to said shifting means for driving the same; and control means for activating said motor means in response to said exposed target being struck.

2. An alternate target apparatus as defined in claim 1 wherein said linkage means is in the form of an elongated member medially supported in the manner of a seesaw to pivot about an axis transverse to said member and to the movement of the targets, and wherein means connect the opposite ends of the elongated member to the respective targets of the pair.

3. An alternate target apparatus as defined in claim 2 wherein a spring is connected to the seesaw member in the manner of a toggle having the dead center position between the opposite alternate target positions operable to resiliently retain said seesaw member and the targets connected thereto in either alternate target position.

4. An alternate target apparatus as defined in claim 1 wherein said linkage means supporting said targets includes a frame disposed substantially normal to the playfield on the underside thereof, slide means guided by the frame to move in general alignment with each respective playfield opening, guide means on the frame adjacent each playfield opening, a substantially inflexible bar connected to each target and cooperating with said guide means and extended therepast and toward the slide means, a flexible spring means connected between said arm and said slide means, whereby said spring means is flexed upon said ball striking and thus moving the exposed target; and the control means including an arm actuated by the flexed spring means operable to close a switch means.

5. An alternate target apparatus as defined in claim 2 wherein said motor means include a solenoid having an armature that reciprocates along a linear axis, and means supporting the solenoid so that said linear axis extends transversely through the pivot axis of said seesaw member; and said connecting means includes a finger carried by the armature and extended transversely thereof and past the seesaw member, means to position the finger in a neutral position when said solenoid is deactivated, a pair of cam means on the seesaw member and spaced generally symmetrically of said pivot axis and associated one each with said targets and each terminating at a shoulder, the cam means associated with the hidden target in either alternate target position being in adjacent canted orientation relative to the neutral finger position, and said finger being rotatable about the linear axis of said armature, whereby activation of said solenoid initially moves the armature to position the finger against the hidden target cam means which then moves along said cam means to said shoulder and whereby continued movement of tha armature thereupon shifts said seesaw member and the targets connected thereto to said opposite alternate target position.

6. An alternate target apparatus as defined on claim 5 wherein said means to position said finger in said neutral position includes stationary faces spaced from and inclined laterally of the pivot axis and converging toward a corner against which said finger seats in the neutral position.

7. An alternate target apparatus as defined in claim 6 wherein the means to position the finger to said neutral position includes a spring adapted to shift the armature with the finger thereon against the inclined faces and toward the corner thereof.

8. An alternate target apparatus as defined in either claims 5, 6 or 7 wherein a spring is connected to the seesaw member in the manner of a toggle having the dead center position between the opposite alternate target positions operable to retain said seesaw member and the targets connected thereto in either alternate position.

* * * * *

UNITED STATES PATENT AND TRADEMARK OFFICE

CERTIFICATE OF CORRECTION

PATENT NO. : 4,243,222

DATED : January 6, 1981

INVENTOR(S) : Grabel et al.

It is certified that error appears in the above—identified patent and that said Letters Patent is hereby corrected as shown below:

Column 1, line 52, change "comes" to --caroms--.

Column 1, line 59, change "top" to --pop--.

Column 1, lines 67 and 68, change "powdered" to --powered--.

Column 2, line 8, change "bit" to --hit--.

Column 3, line 10, change "alternatively" to --alternately--.

Column 3, line 64, change "comes" to --caroms--.

Column 5, line 18, change "and" to --the--.

Column 6, line 23, change "extrusion" to --extension--.

Column 8, line 25, change "tha" to --the--.

Column 8, line 29, change "on" to --in--.

Signed and Sealed this

*First* Day of *June 1982*

[SEAL]

*Attest:*

GERALD J. MOSSINGHOFF

*Attesting Officer*

*Commissioner of Patents and Trademarks*